United States Patent [19]

Palazzolo

[11] Patent Number: 4,854,210

[45] Date of Patent: Aug. 8, 1989

[54] DETACHABLE ELECTRIC GUITAR PICK-UP SYSTEM

[76] Inventor: Nicholas P. Palazzolo, P.O. Box 1926, Lomita, Calif. 90717-5926

[21] Appl. No.: 89,401

[22] Filed: Aug. 26, 1987

[51] Int. Cl.[4] ..... G10H 3/18; G10D 1/08

[52] U.S. Cl. ..... 84/1.15; 84/1.16

[58] Field of Search ..... 84/1.14–1.16, 84/DIG. 24, 267, 291, 292

[56] References Cited

U.S. PATENT DOCUMENTS

| | | | |
|---|---|---|---|
| 4,133,243 | 1/1979 | DiMarzio . | |
| 4,184,399 | 1/1980 | Zuniga . | |
| 4,220,069 | 9/1980 | Fender . | |
| 4,269,103 | 5/1981 | Underwood . | |
| 4,283,982 | 8/1981 | Armstrong . | |
| 4,364,295 | 12/1982 | Stich | 84/1.15 |
| 4,372,186 | 2/1983 | Aaroe . | |
| 4,425,831 | 1/1984 | Lipman | 84/1.16 |
| 4,433,603 | 2/1984 | Siminoff | 84/1.16 |
| 4,442,749 | 4/1984 | DiMarzio . | |
| 4,463,648 | 8/1984 | Fender . | |
| 4,472,994 | 9/1984 | Armstrong | 84/1.16 X |
| 4,524,667 | 6/1985 | Duncan . | |
| 4,535,668 | 8/1985 | Schaller . | |
| 4,580,481 | 4/1986 | Schaller . | |
| 4,738,178 | 4/1988 | Derring | 84/1.15 X |

FOREIGN PATENT DOCUMENTS

| | | | |
|---|---|---|---|
| 2599881 | 12/1987 | France | 84/1.16 |
| 0008815 | 1/1977 | Japan | 84/1.15 |

*Primary Examiner*—Stanley J. Witkowski
*Assistant Examiner*—John G. Smith
*Attorney, Agent, or Firm*—Lee W. Tower

[57] ABSTRACT

A detachable electric stringed instrument pickup system for an electrical stringed instrument of the type including a body, a neck having a head, a bridge assembly connected to the body, and a plurality of strings positioned between tbe head and the bridge assembly includes a mounting fixture having an opening attached to the front of the body of the electrical stringed instrument under the strings, a base plate attached by height adjustment screws to the mounting fixture, and a height adjustment spring biasing the base plate away from the mounting fixture and also includes a first connector for elecrical connection mounted on the base plate and a second connector for electrical connection mounted on an assembly mount and detachably plugged into the first connector through the opening in the mounting fixture and wherein an electromagnetic pickup is mounted on the assembly mount and electrically connected to the second connector.

12 Claims, 3 Drawing Sheets

DETACHABLE ELECTRIC GUITAR PICK-UP SYSTEM

BACKGROUND OF THE INVENTION

1. Field of the Invention

The present invention relates to an electric guitar pick-up system, and more particularly to a detachable electric guitar pickup system that provides a musician an easy way to change pick-up systems on his/her electric guitar.

2. Description of the Prior Art

This invention relates broadly to electrical musical instruments of the string type. It is typically applicable to an electrical guitar or bass guitar or similar musical instrument having a plurality of stretched strings extending across a body and a neck, between the head of the instrument and a bridge assembly connected to the body, in which the strings are caused to vibrate by plucking or picking same.

In order to derive an output from such an electrical guitar, bass guitar or other similar electrical musical instrument, the instrument is conventionally provided with an electromagnetic pick-up comprising a number of magnetic elements (pole pieces) having wound there around a conductive coil. Typically, one such magnetic element is disposed directly beneath each string of the instrument. The strings are constructed of a magnetizable substance, such as steel, and, therefore, become part of the conductive path for the magnetic lines of flux of the pole pieces. Accordingly, when any of the strings are caused to vibrate this causes a disturbance in the magnetic field of the associated pole piece. This has the effect of generating a voltage in the conductive coil which voltage may be suitably amplified and transmitted to a loudspeaker system.

The current state of the art has many different designs for electric guitar pick-up systems. Each of the designs of the current state of the art claim certain advantages. Schaller Pat. No. 4,580,481 describes a pick-up for a guitar having a coil which is provided with two magnets that can be individually changed in position such that the magnetic field of each magnet is restricted to a group of only three strings thus changing the position of a magnet will only affect the signal of one group of strings in volume or phase, so that for instance the sound volumes of the two groups of strings can be brought into any desired balance. Another Schaller invention Pat. No. 4,535,668 has as its specific object to provide a pick-up whereby the strength and phase of the output signal produced by the vibration of each string of the instrument with which it is used may be individually adjusted by hand in a simple manner without the need for special tools. Duncan Pat. No. 4,524,667 discloses a pick-up system having a coil stack assembly in which coils are combined with permanent magnet members and stacked one on top of the other. An advantage of the Duncan design is that by selectively varying the geometrical dimensions of the permanent magnet material, the pole piece and the air gap, a wide range of output sounds can be obtained. Another advantage is that the stacked coils which are wound in separate directions eliminate the pick-up of a 60 cycle hum.

Fender Pat. No. 4,463,648 describes a pick-up which provides better separation between the sound from each string and a humbucking pick-up. The humbucking pick-up is designed to reject magnetic fields from lighting fixtures, motors, transformers and the like, which are sources of 60 hertz noise and would cause 60 cycle hum to be picked up by the pick-up and amplified through a loudspeaker system, manifesting an objectionable hum. The humbucking pick-up overcomes this problem by including a pair of identical pick-up assemblies each having a plurality of magnetic pole pieces and a coil, pick-up assemblies being positioned in parallel, spaced, closely adjacent relationship. The coils of the two pick-up assemblies are run in opposite directions and the two coils are connected either in series or in parallel. Because the direction of current flow in each coil is governed by the magnetic polarity, the direction of current from one coil is opposite to that of the other coil for each string. However, since the directions of the windings of the two coils are opposite the signals induced in the coils as a result of string vibrations are additive and the output signal is the sum of the signals induced in each coil. All of the pole pieces of one of the pick-up assemblies have their North poles adjacent to the strings and their South poles relatively remote from the strings whereas all of the pole pieces of the other pick-up assembly have their South poles adjacent to the strings and the North poles relatively remote from the strings. Signals from external sources such 60 cycle power hum are independent of the magnetic polarity and accordingly, such power line sources produce voltage that are in phase. However since the coils are wound in opposite directions, these in phase signals cancel and the output signal is the difference between the powerline signals induced in each coil. This means that any noise from power sources which is only manifested as an objectionable hum, is effectively reduced or cancelled. The Pat. No. 4,463,648 improves upon the humbucking pick-up by mounting the pick-up on the body of an electrical instrument at an obtuse angle relative to the direction of the strings, the angle of mounting of the housing being a direct function of the longitudinal offset whereby each of the pick-up assemblies is centered under the strings. This improves the harmonic content and thereby the sound produced by the pick-up.

DiMarzio Pat. No. 4,442,749 describes an electrical pick-up comprising a pair of superimposed co-axial bobbins, each axial wound with a coil having its axis perpendicular to the stringed instrument strings, an integral plate of magnetic material comprising a base disposed between the two bobbins perpendicular to the coil axis and two side walls extending upwardly and perpendicularly from a base to at least immediately below the top base of the upper bottom and a plurality of rod-like permanent magnets extending through at least the upper coil parallel to the axis thereof and in contact with the base of the integral plate and wherein the magnets have like pluralities at the tops thereof. Again this double coil design is such that externally generated hum will be eliminated. The DiMarzio design claims to produce a strong signal while at the same time eliminating the hum of 60 cycles. DiMarzio also claims that humbucking pick-ups such as the Fender design described above causes string vibrations to be sensed over a relatively broad length of string, that results in cancellation of various frequencies, due to the spacing of the coils under the strings. The DiMarzio design claims to eliminate this problem.

Aaroe Pat. No. 4,372,186 is another design of a humbucking electromagnetic pick-up. The Aaroe pick-up employs a single coil wound in two oppositely wound and concentric sections. The key advantage of the Aaroe design is that the concentric coils are very closely spaced. This helps to eliminate any imbalance between the two side legs of one coil, or the output of the conventional humbucking configuration of two coils wound in opposition which could result from an interfering radiation that is not at a point substantially normal to the plane of the instrument strings above the coils.

Armstrong Pat. No. 4,283,982 describes another magnetic pick-up for electric guitars. In the Armstrong design a polar magnet positioned longitudinally parallel to the coil and having its polar axis perpendicular to the winding axis of the coil is provided. Within the coil is either a magnet or a pole piece. The pick-up may include a plurality of coils and magnets arranged as described above to increase the effectiveness of the pick-up. Armstrong claims that this design produces a signal allowing for amplification of the natural full tones of a stringed musical instrument.

Underwood, Fender and DiMarzio, Pat. Nos. 4,269,103, 4,220,069 and 4,133,243, respectively, provide various single coil electric pick-up designs.

Clearly there are a multitude of ways of implementing an electric pick-up for an electric guitar. Other prior art that relates to the present invention is related to the assembly of the magnetic pick-ups. Zuniga Pat. No. 4,184,399 describes an assembly housed in a casing having acoustic absorptive material surrounding the major portions of the assembly, to provide acoustic isolation from the environment including mechanical vibration of the instrument itself. The assembly also includes adjusting means for varying the distance between the pick-up and all the strings simultaneously The generally rectangular casing for housing the pick-ups has a pair of leaf springs one at each end of the casing and extending transversely thereof for biasing the respective casing end away from the strings and a selectively adjustable threaded member at each end of the casing for drawing the respective casing in toward the springs. The operation of the springs on the casing provides a means for selectively adjusting the vertical position of the casing relative to the body and the frame and thereby the strings of the instrument. The frame itself is attached to the body of the electric guitar by attaching means such as screws. The adjustable threaded members at each end of the casing are also screws which attach to the casing through the frame.

Another patent which addresses the assembly of the electrical pick-up to a guitar is Stich Pat. No. 4,364,295. The Stich design is very similar to the Zuniga design; however, the leaf springs of Zuniga have been replaced by compression springs mounted on the threaded screw members. Again, the Stich design allows the spacing between the coils and the strings of the instrument to be varied by turning the threaded screw members.

From the foregoing it is apparent that there are a number of possible designs for an electromagnetic pick-up for a stringed musical instrument. All of these designs have their own advantages and sound qualities. Because of the different sound quality of each possible design, a musician may want to change the electromagnetic pick-up he is using to achieve different sound qualities for different musical pieces. To accomplish this with current state of the art, a guitarist will need to use a number of different guitars all set up with different electromagnetic pick-up systems to enable him to achieve different musical qualities for different musical pieces during the same performance. Also a guitarist today may need to change the electromagnetic pick-up of his guitar as styles change and another sound becomes more popular.

A disadvantage with today's electromagnetic pick-ups is that they are all permanently attached to the guitar by screws. Typically to install or replace a pick-up today requires the services of a professional musical instrument craftsman. Clearly, this could not be done during a performance. Thus, as described above, the guitarist must have a number of guitars with different pick-ups already installed ready for his use. This is relatively expensive.

Accordingly, there is a need for an electromagnetic pick-up for stringed instruments that can be easily installed and removed. Such an improvement in electromagnetic pick-ups will be very valuable and desirable in the field of electric guitars and other electric stringed instruments.

SUMMARY OF THE INVENTION

With the above background in mind, it is among the primary objectives of the present invention to provide an improved detachable electric guitar pick-up system. It is another object of the present invention to provide an electromagnetic pick-up system that can be easily installed and removed without the services of a professional musical instrument craftsman or repairman. Another objective of the present invention is to provide for the easy installation and removal of different types of electromagnetic pick-ups on the same guitar. It is another objective of the present invention that there be a mechanism whereby the distance between the electric guitar pick-up pieces and coils and the guitar strings can be adjusted.

These objectives are accomplished by having a detachable electric stringed instrument pickup system for an electrical stringed instrument of the type including a body, a neck having a head, a bridge assembly connected to said body, and a plurality of strings positioned between the head and bridge assembly of the electric stringed instrument. A mounting fixture having an opening is attached by screws to the body of the electrical stringed instrument under the strings. Then a base plate is attached to the mounting fixture through the opening in the mounting fixture by height adjustment screws, such that the height adjustment springs bias the base plate away from the mounting fixture and the strings. A first set of connectors for electrical connection are mounted on the base plate and wires from these connectors lead to the amplifiers. A second set of connectors for electrical connection are mounted on a detachable assembly mount. The second set of connectors match the first set of connectors, are aligned with them and are detachably pluggable into the first set of connectors means through the opening in the mounting fixture. The electromagnetic pickup is mounted on the assembly mount and has at least one magnet and at least one conducting coil of wire wound around the magnet with the beginning and end of the conducting coil electrically connected to the second set of connectors.

The first set of connectors can be miniature chassis jacks and the second set of connectors on the assembly mount can be miniature plugs.

The invention herein described is capable of working with electromagnetic pick-up designs which have either single coils or double coils. In the case of the double coils the coils can be mounted side by side or one on top of the other. In either case the electromagnetic pickup includes a plurality of conducting coils each wound around at least one magnet. Each of the conducting coils has a beginning and an end and each beginning and end of each coil is attached to a plug. Therefore, for each coil there are two plugs mounted on the assembly mount. There are a matching number of chassis jacks mounted on the base plate in alignment with the plugs. This permits the plugs to mate with the chassis jacks and not only provides a method of conducting signals, but also provides a method of attaching the detachable assembly mount to the base plate. Shielded conductors are connected to each of the chassis jacks and are sent to electronics that amplify the signals and feed them into speakers. The conductor shields are attached to the base plate, which is grounded to provide reduce electromagnetic interference.

Instead of having the plugs on the assembly mount and the chassis jacks on the base plate, it is possible to have the plugs on the base plate and the chassis jacks on the assembly mount.

The supporting structure which ties the coils, magnets and connectors together into one detachable assembly will be more fully described in the specification which follows: however, it should be clear that variations in the supporting structure may be required to accommodate various different designs of electromagnetic pick-up systems.

To change an electromagnetic pick-up from one type to another, it is only necessary to unplug one detachable electromagnetic pick-up assembly and plug in another one. It is not necessary that the permanently fixed mounting assembly be detached from the guitar. It may only be necessary to adjust the height adjustment screws to adjust the space between the electromagnetic pick-up assembly and the strings of the guitar or other stringed musical instrument.

The features of the present invention which are believed to be novel are set forth with particularity in the appended claims. Other objects and many of the attendant features of this invention will be more readily appreciated as the same becomes better understood by reference to the following detailed descriptions and considered in connection with the accompanying drawings in which like reference symbols designate like parts throughout the figures.

DESCRIPTION OF THE PREFERRED EMBODIMENT

Figure 1:
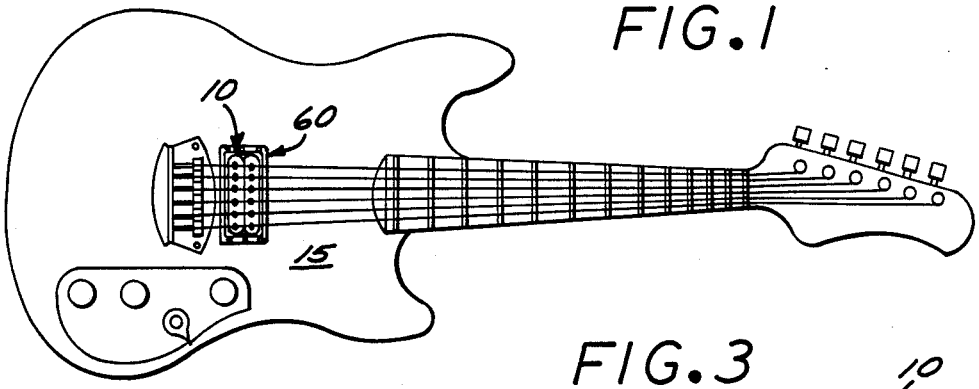
FIG. 1 is electric guitar showing a detachable electromagnetic pick-up system attached thereto.
Figure 2:
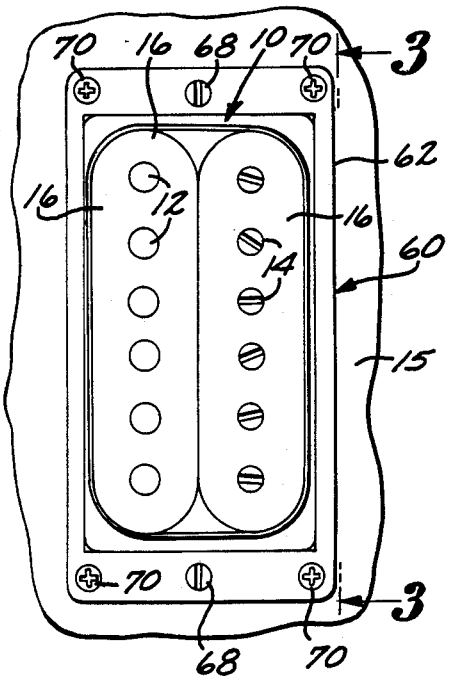
FIG. 2 is a top view of a detachable electromagnetic pick-up mounted on a guitar.

The present invention is a detachable electric guitar pickup system, which is comprised of a detachable electromagnetic pickup assembly 10 and a permanently fixed mounting assembly 60. The permanently fixed mounting assembly is attached to guitar 15 as shown in FIG. 1. A detachable electric guitar pickup system is mounted underneath the strings of the electric guitar in the same position as any electric guitar pickup system would be mounted. This is normally just in front of the bridge of the electric guitar. FIG. 2 shows a detailed top view of the detachable electric guitar pickup system mounted on guitar 15. As shown, the detachable electromagnetic pickup assembly 10 is further comprised of coil forms 16 around which coils are wound, non-adjustable magnetic pole pieces 12 and adjustable magnetic pole pieces 14. As indicated in the description of the prior art, the strings are constructed of a magnetizable substance such as steel and therefore become part of the conductive path for the magnetic lines of flux of the magnetic pole pieces. Accordingly, when any of the strings are caused to vibrate this causes a disturbance in the magnetic field of the associated pole piece. This in turn has the effect of generating a voltage in the coils which are wrapped around coil forms 16, which voltage may be suitably amplified and transmitted to a loud speaker system. The detachable electromagnetic pickup assembly 10 is plugged into the permanently fixed mounting assembly 60, which is permanently attached to the guitar or other electrical musical instruments of the string type by exterior mounting screws 70. These exterior mounting screws are screwed directly into the guitar body 15.

Figure 3:
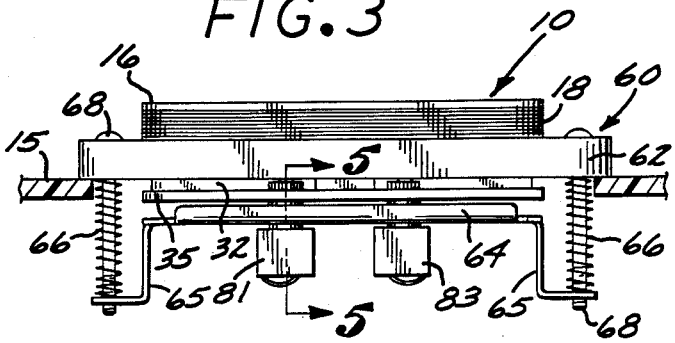
FIG. 3 is a partial section of FIG. 2 showing the detachable electromagnetic pick-up assembly plugged into the permanently fixed mounting assembly and showing the height adjustment springs and screws.

The other screws apparent in FIG. 2 are height adjustment screws 68. Their function becomes more apparent by inspection of FIG. 3 which is a side section of FIG. 2. As shown in FIG. 2 and FIG. 3 it is exterior mounting fixture 62 that is permanently fixed to the guitar body 13 by exterior mounting screws 70. Base plate 64 is movably mounted to exterior mounting fixture 62 by height adjustment screws 68. Height adjustment springs 66 around height adjustment screws 68 bias base plate 64 away from exterior mounting fixture 62. Base plate 64 and anything mounted thereon can be raised and lowered with respect to exterior mounting fixture 62 by adjusting height adjustment screws 68: the base plate 64 is raised by turning height adjustment screws 68 clockwise and base plate 64 is lowered by turning height adjustment screws 68 counterclockwise. As shown in FIG. 3, base plate 64 is provided with mounting extension 65 which allows the base plate 64 to be raised above exterior mounting fixture 62, if necessary.

Also shown in FIG. 3 is coil winding 18 wrapped around coil form 16. For the design shown in FIG. 2, there are two coil forms 16 each with a coil 18 wrapped around it.

Figure 5:
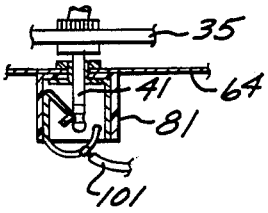
FIG. 5 is a section of FIG. 3 showing a plug mounted on the detachable electromagnetic pick-up assembly plugged into a chassis jack mounted on the permanently fixed mounting assembly.

Shown in FIG. 3 are chassis jacks 81 and 83 mounted to base plate 64. Corresponding to these chassis jacks are miniature plugs mounted to the bottom of detachable electromagnetic pickup assembly 10. FIG. 5 shows a detail of miniature plug 41 plugged into chassis jack 81. As shown, the chassis jack is attached or mounted onto base plate 64. Miniature plug 41 is mounted onto shielded base assembly mount 35.

Figure 4:
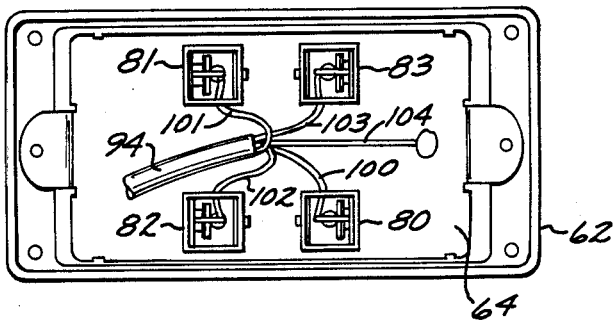
FIG. 4 is a bottom view of the detachable electromagnetic pick-up system.

FIG. 4 is a bottom view of the detachable electric guitar pickup system. In this view, the notable items are the bottom views of four chassis jacks 80, 81, 82 and 83, which are attached to conductors 100, 101, 102 and 103, respectively. Conductor 104 is a shield that is attached to base plate 64. All of these conductors are sent through cable 94 to an amplifier which can convert the voltage forms into suitable driving signals for a speaker system.

As shown in FIG. 4, for the two coil pickup system of FIG. 2, four chassis jacks are used. This is so that both ends of each of two coils can be wired via conductors 100, 101, 102 and 103 to an amplifier.

Figure 6:
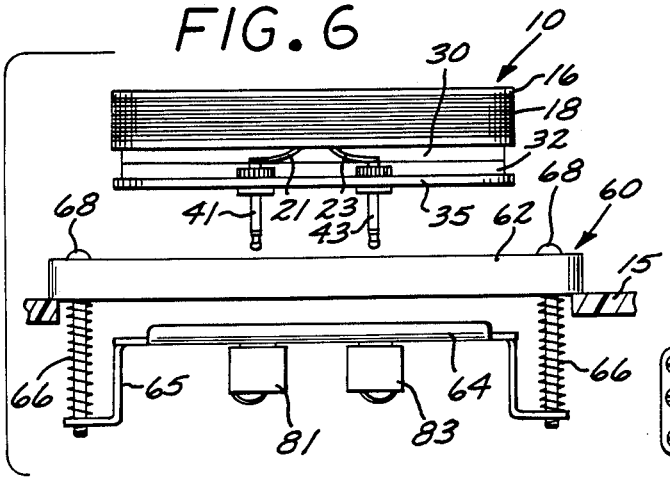
FIG. 6 is a partial section showing the detachable electromagnetic pick-up assembly unplugged from the permanently fixed mounting assembly on the guitar.

FIG. 6 is essentially the same as FIG. 3 except that the detachable electromagnetic pickup assembly is shown detached from the permanently fixed mounting assembly 60. Here it is clearly shown that miniature plugs 41 and 43 are placed on the detachable electromagnetic pickup assembly in such a position that they can mate with the corresponding chassis jacks 81 and 83 mounted on base plate 64. Conductors 21 and 23 are electrically connected to miniature plugs 41 and 43, respectively. These two conductors correspond to the two ends of coil 18.

Figure 7:
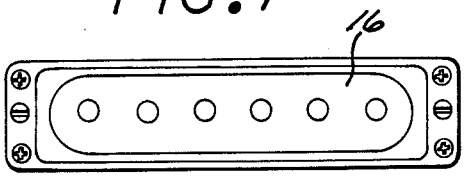
FIG. 7 shows an alternate form of the detachable electromagnetic pick-up assembly with one instead of two coils.

It is possible to have a detachable electric guitar pickup system with just one coil as shown in FIG. 7. As shown in FIG. 7, one possible design for a single coil system is to have a permanently fixed mounting assembly that is correspondingly smaller, because if only one coil system is used such as shown in FIG. 7, then only two chassis jacks are required, because only two ends of the coil would have to be wired to an amplifier. Another approach is to make the interface between the detachable electromagnetic pickup assembly and the permanently fixed mounting assembly identical regardless of the magnetic pickup design. Thus, in the case of the single coil pickup, four plugs would be used on the detachable electromagnetic pickup assembly instead of only two and the permanently fixed mounting assembly would be identical to that used for the two coil electromagnetic pickup and have four jacks. In this case the two ends of the one coil can each be electrically connected to two plugs for a total of four plugs and the permanently fixed mounting assembly 60 would be identical to the design shown in FIGS. 4 and 8. This would allow the interchange of single and double coil pickups on the same guitar, which is a great advantage due to the substantial sound difference between the sound of single and double coil pickups.

Figure 10:
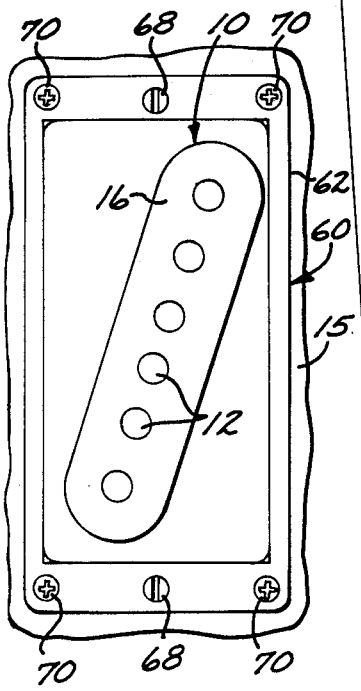
FIG. 10 is a top view of a detachable electromagnetic pickup mounted on a guitar with the pickup mounted on an obtuse angle to the strings.

There is another advantage of using the same size permanently fixed mounting assembly for one and two coil electromagnetic pickups. When only one coil is used there is sufficient space on the detachable electromagnetic pickup assembly to mount a single coil electromagnetic pickup at an obtuse angle onto the base assembly mount, as shown in FIG. 10. Then when the detachable electromagnetic pickup is plugged into the permanently fixed mounting assembly the electromagnetic pickup coil would be at an obtuse angle to the strings. This arrangement provides yet another sound quality as compared to a double coil system or a nonangled single coil system.

Figure 8:
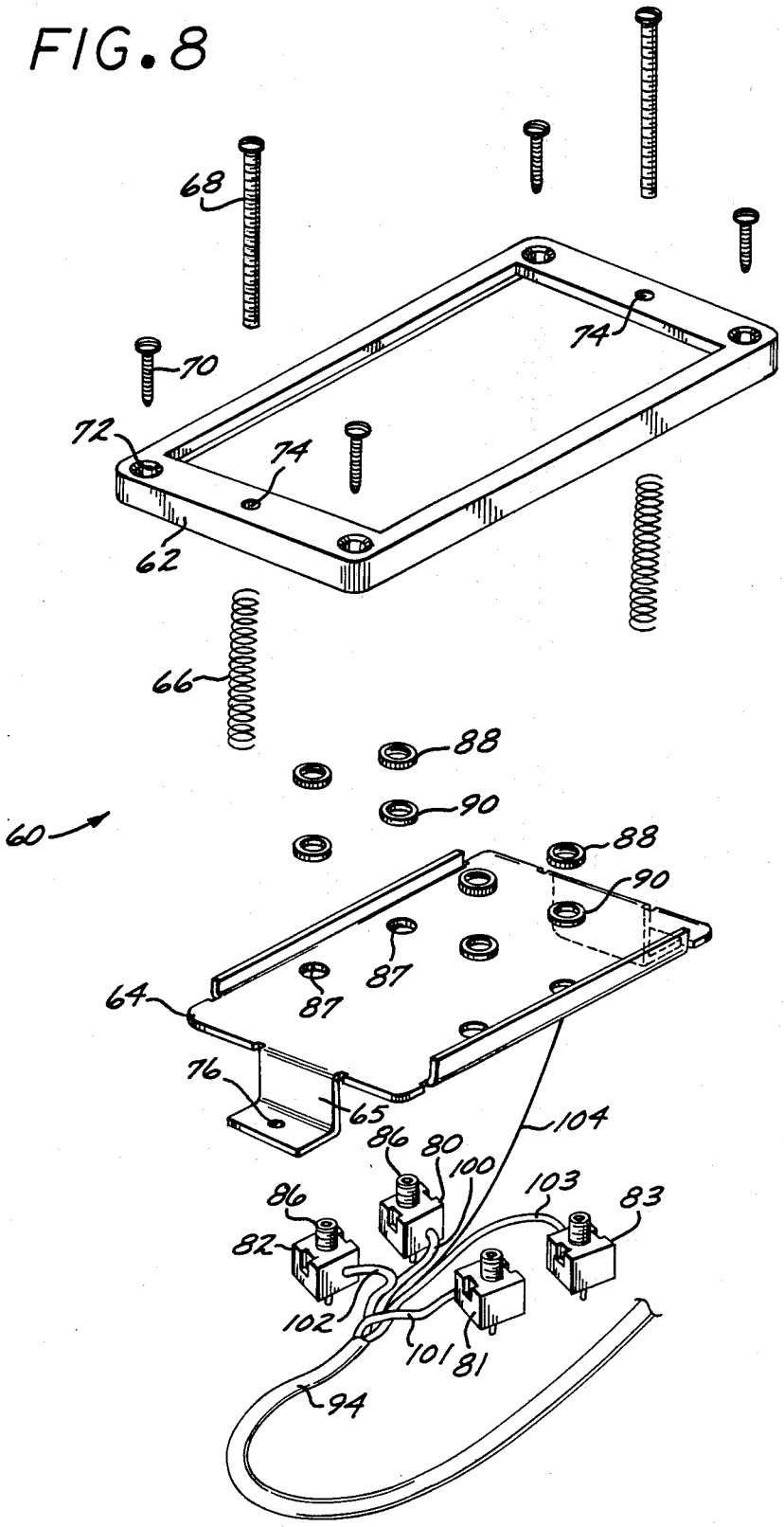
FIG. 8 is an exploded view of the permanently fixed mounting assembly.

FIG. 8 shows an exploded view of the permanently fixed mounting assembly 60. The exterior mounting fixture 62 has four exterior mounting ring screw holes 72 and two height adjustment screw holes 74. Four exterior mounting screws 70 are provided as well as two height adjustment screws 68. As shown, the height adjustment screws are threaded through height adjustment screw holes 74 and through height adjustment springs 66 and attached to base plate 64 via second height adjustment screw holes 76 in base plate 64. Chassis jacks 80, 81, 82, and 83 are attached to base plate 64 via threaded plug receptacles 86 which extend through base plate holes 87 in base plate 64. Washers 90 are slipped over threaded plug receptacles 86 and then nuts 88 are screwed on to the threaded plug receptacles thereby attaching the chassis jacks to the base plate.

Figure 9:
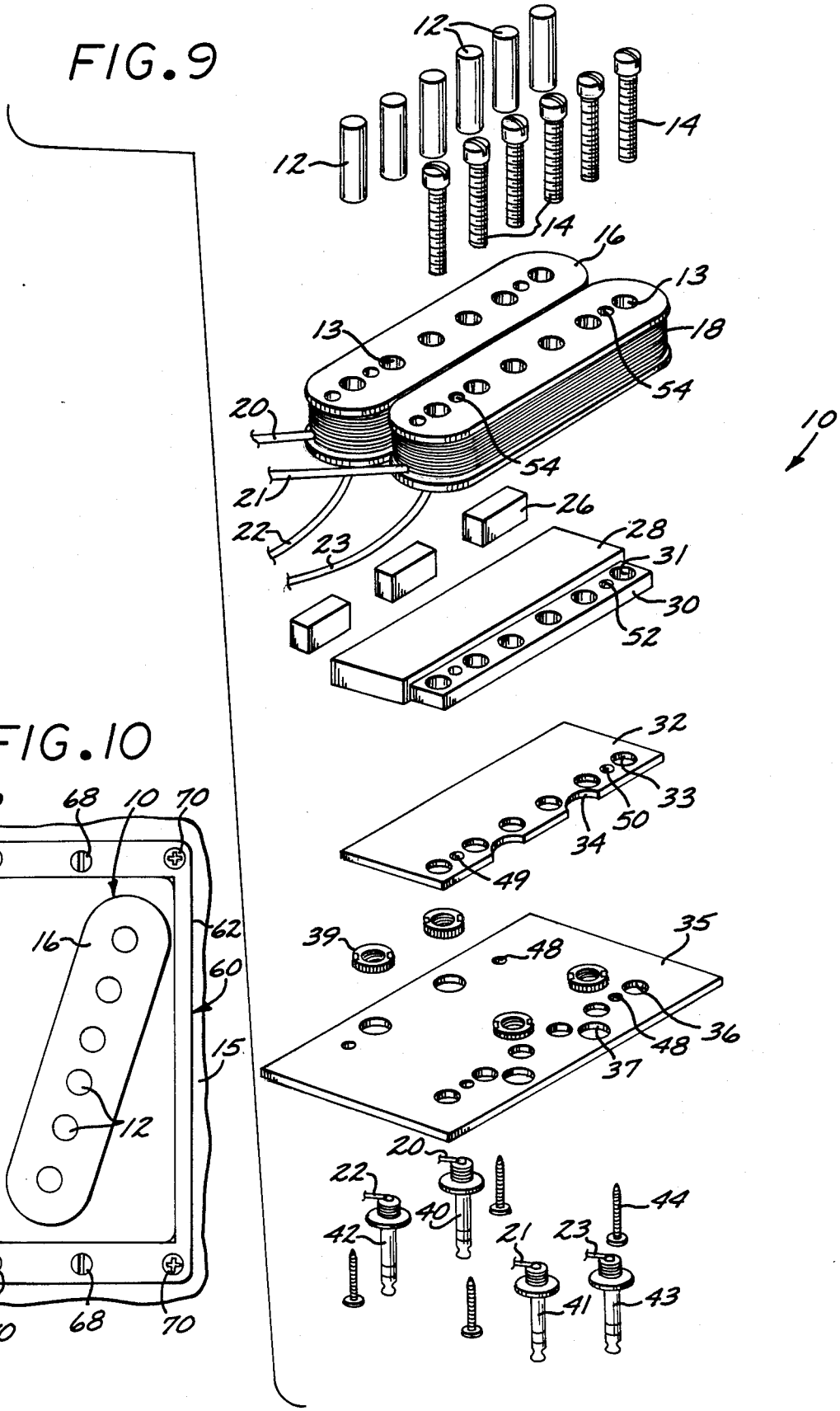
FIG. 9 is an exploded view of the detachable electromagnetic pick-up assembly.

FIG. 9 shows an exploded view of the detachable electromagnetic pickup assembly. As shown, nonadjustable pole pieces 12 are placed in holes 13 in coil form 16. Adjustable pole pieces 14 are placed in holes 13 in another coil form 16. Coils 18 are wound around each coil form 16. Both ends of each coil, namely conductor 20 and 22 and conductors 21 and 23, are brought out of the coil and wired to miniature plugs 40 and 42 and 41 and 43, respectively. Immediately under the coil forms, magnet 28 is placed. This magnet has the property of strengthening the magnetic lines of flux thereby increasing the performance of the pickup. Along the side of magnet 28 is iron alignment block 30. Adjustable pole pieces 14 are screwed into threaded holes 31 in iron alignment block 30. Immediately below magnet 28 and iron alignment block 30, is shielded spacer plate 32, which is made of epoxy glass and is copperclad on the side in contact with magnet 28 and iron alignment block 30. Adjustable pole pieces 14 are threaded through threaded holes 33 in shielded spacer plate 32. Shielded spacer plate 32 also has clearance cutouts 34, which provide clearance for nuts 39. Shielded spacer plate 32 rests on shielded base assembly mount 35. Again, adjustable pole pieces 14 are threaded through threaded holes 36 and shielded base assembly mount 35. Spacer blocks 26 are placed along side of magnet 28 and shielded spacer plate 32. These spacer blocks are equivalent in height to the combined height of magnet 28 and shielded spacer plate 32. Their function is for support only.

Miniature plugs 40, 41, 42 and 43 are attached to shielded base assembly mount 35 by inserting them through holes 37 in shielded base assembly mount 35 and threading nuts 39 onto the plugs' threaded portions. As previously mentioned, plugs 40, 41, 42 and 43 are wired to the coils via conductors 20, 21, 22 and 23, respectively. The entire detachable electromagnetic pickup assembly is held together by assembly screws 44 of which there are four. Two of the assembly screws 44 are screwed through holes 48, 50, 52 and 54 in the shielded base assembly mount, the shielded spacer plate, the iron alignment block 30 and coil forms 16, respectively. The other two assembly screws 44 bypass the shielded spacer plate 32 and the alignment block 30.

The features of the present invention which are believed to be novel are set forth with particularly in the appended claims.

Although the foregoing has been a description and illustration of a specific embodiment of the invention, various modifications and changes thereto can be made by persons skilled in the art without departing from the scope and spirit of the invention as defined by the following claims.

What is claimed is:

1. A detachable electric stringed instrument pickup system for an electrical stringed instrument of the type including a body, a neck having a head, a bridge assembly connected to the body, and a plurality of strings positioned between the head and the bridge assembly, that comprises:

a mounting fixture having an opening wherein said mounting fixture is attached to a body of an electrical stringed instrument under a plurality of strings; and a base plate attached by height adjustment screws to said mounting fixture; and a height adjustment spring biasing said base plate away from said mounting fixture; and a first connector means for electrical connection mounted on said base plate; and an assembly mount; and a second connector means for electrical connection mounted on said assembly mount and detachably pluggable into said first connector means through said opening in said mounting fixture; and a means for electromagnetic pickup mounted on said assembly mount and having at least one magnet and at least one conducting coil of wire having a beginning and an end, wound around said magnet with the beginning and end of said conducting coil of wire electrically connected to said second connector means.

2. The detachable electric stringed instrument pickup system of claim 1, wherein:

said first connector means comprises jacks; and said second connector means comprises plugs.

3. The detachable electric stringed instrument pickup system of claim 1, wherein:

said means for electromagnetic pickup is mounted at an obtuse angle on said assembly mount.

4. A detachable electric stringed instrument pickup system for an electrical stringed instrument of the type including a body, a neck having a head, a bridge assembly connected to the body, and a plurality of strings positioned between the head and the bridge assembly, that comprises:

a mounting fixture having an opening wherein said mounting fixture is attached to a body of an electrical stringed instrument under a plurality of strings; and a base plate attached by height adjustment screws to said mounting fixture; and a height adjustment spring biasing said base plate away from said mounting fixture; and a first connector means for electrical connection mounted on said base plate; and a second connector means for electrical connection mounted on said base plate; and an assembly mount; and a third connector means for electrical connection mounted on said assembly mount; and a fourth connector means for electrical connection mounted on said assembly mount; and a means for electromagnetic pickup mounted on said assembly mount and having at least one magnet and at least one conducting coil of wire having a beginning and end wound around said magnet with said beginning of said conducting coil of wire electrically connected to said third connector means and said end of said conducting coil of wire electrically connected to said fourth connector means; and wherein said first connector means is aligned with said third connector means and said second connector means is aligned with said fourth connector means; and wherein said assembly mount is detachably connected to said base plate through said opening in said mounting fixture such that said first connector means connects to said third connector means and said second connector means connects to said fourth connector means.

5. The detachable electric stringed instrument pickup system of claim 4, wherein:

said first connector and second connector means each comprise jacks; and said third connector means and fourth connector means plugs.

6. In a detachable electric stringed instrument pickup system for an electrical stringed instrument of the type including a body, a neck having a head, a bridge assembly connected to the body, a plurality of strings positioned between the head and the bridge assembly, a mounting fixture having an opening wherein said mounting fixture is attached to the body of the electrical stringed instrument under the strings, a base plate attached by height adjustment screws to the mounting fixture, and a height adjustment spring biasing the base plate away from the mounting fixture, wherein the improvement comprises: a first connector means for electrical connection mounted on said base plate, an assembly mount, a second connector means for electrical connection mounted on said assembly mount and detachably plugged into said first connector means through an opening in said mounting fixture and a means for electromagnetic pickup mounted on said assembly mount and electrically connected to said second connector means.

7. In a detachable electric stringed instrument pickup system according to claim 6, wherein said means for electromagnetic pickup comprises a conducting coil wound around at least one magnet, said conducting coil having a beginning and an end, wherein said second connector means comprises a first plug electrically connected to said beginning of said conducting coil and a second plug electrically connected to said end of said conducting coil and wherein said first connector means comprises a first jack mounted on said base plate in alignment with said first plug mounted on said assembly mount and a second jack mounted on said base plate in alignment with said second plug mounted on said assembly mount such that said first plug is detachably pluggable into said first jack and said second plug is detachably pluggable into said second jack.

8. In a detachable electric stringed instrument pickup system according to claim 6, wherein said means for electromagnetic pickup comprises a plurality of conducting coils each wound around at least one magnet, each of said plurality of conducting coils having a beginning and an end, wherein said second connector means comprises a matching plurality of first plugs each electrically connected to said beginning of one of said plurality of conducting coils and a matching plurality of second plugs each electrically connected to said end of one of said plurality of conducting coils and wherein said first connector means comprises a matching plurality of first jacks mounted on said base plate in alignment with said matching plurality of first plugs mounted on said assembly mount and a matching plurality of second jacks mounted on said base plate in alignment with said matching plurality of second plugs mounted on said assembly mount such that each said first plug is detachably pluggable into each said first jack and each said second plug is detachably pluggable into each said second jack.

9. In a detachable electric stringed instrument pickup system according to claim 6, wherein said means for electromagnetic pickup comprises a plurality of conducting coils each wound around at least one magnet, each of said plurality of conducting coils having a beginning and an end, wherein said second connector means comprises a matching plurality of first male connectors each electrically connected to said beginning of one of said plurality of conducting coils and a matching plurality of second male connectors each electrically connected to said end of one of said plurality of conducting coils and wherein said first connector means comprises a matching plurality of first female connectors mounted on said base plate in alignment with said matching plurality of first male connectors mounted on said assembly mount and a matching plurality of second female connectors mounted on said base plate in alignment with said matching plurality of second male connectors mounted on said assembly mount such that each said first male connector is detachably pluggable into each said first female connector and each said second male connector is detachably pluggable into each said second female connector.

10. In a detachable electric stringed instrument pickup system according to claim 6, wherein said means for electromagnetic pickup comprises a plurality of conducting coils each wound around at least one magnet, each of said plurality of conducting coils having a beginning and an end, wherein said second connector means comprises a matching plurality of first female connectors each electrically connected to said beginning of one of said plurality of conducting coils and a matching plurality of second female connectors each electrically connected to said end of one of said plurality of conducting coils and wherein said first connector means comprises a matching plurality of first male connectors mounted on said base plate in alignment with said matching plurality of first female connectors mounted on said assembly mount and a matching plurality of second male connectors mounted on said base plate in alignment with said matching plurality of second female connectors mounted on said assembly mount such that each said first female connector is detachably pluggable into each said first male connector and each said second female connector is detachably pluggable into each said second male connector.

11. The detachable electric stringed instrument pickup system of claim 4, wherein:

said means for electromagnetic pickup is mounted at an obtuse angle on said assembly mount.

12. In a detachable electric stringed instrument pickup system according to claim 6, wherein said means for electromagnetic pickup is mounted at an obtuse angle on said assembly mount.

* * * * *